United States Patent [19]

Hardy

[11] Patent Number: 4,744,473

[45] Date of Patent: May 17, 1988

[54] KNOCK-DOWN END CAP MERCHANDISE DISPLAY UNIT COMPRISING VERTICALLY SPACED MERCHANDISE RECEIVING TRAYS PROVIDED WITH FORWARD AND REARWARD ADJUSTMENT THEREOF

[75] Inventor: Stephen N. Hardy, Copley, Ohio

[73] Assignee: American Greetings Corporation, Cleveland, Ohio

[21] Appl. No.: 832,427

[22] Filed: Feb. 24, 1986

[51] Int. Cl.[4] ..... A47F 7/00

[52] U.S. Cl. ..... 211/55; 211/128; 211/194; 206/509

[58] Field of Search ..... 211/50, 128, 49.1, 55, 211/126, 194, 163, 188, 52; 206/508, 45.14, 821, 509; 108/91, 92, 93, 101

[56] References Cited

U.S. PATENT DOCUMENTS

| | | | |
|---|---|---|---|
| 1,059,266 | 4/1913 | Boller | 211/55 X |
| 2,182,460 | 12/1939 | Werner | 211/128 |
| 2,283,301 | 5/1942 | Waddell | 211/128 X |
| 2,526,246 | 10/1950 | Leeper | 108/101 |
| 2,937,763 | 5/1960 | Ingold | 211/128 |
| 3,191,776 | 6/1965 | Tokash | 211/55 |
| 3,198,340 | 8/1965 | Tokash | 211/49.1 |
| 3,524,553 | 8/1970 | Zitmore | 211/128 |
| 3,667,617 | 6/1972 | Cohn | 211/128 |
| 4,099,627 | 7/1978 | Strada | 211/194 X |
| 4,161,252 | 7/1979 | Howells | 211/126 |
| 4,162,014 | 7/1979 | Bobrick | 211/50 |
| 4,479,684 | 10/1984 | Doyel | 312/330 R |

FOREIGN PATENT DOCUMENTS

| | | | |
|---|---|---|---|
| 0161594 | 11/1986 | European Pat. Off. . | |
| 2540468 | 5/1984 | France | 206/508 |
| 1273473 | 5/1972 | United Kingdom . | |
| 2008543 | 6/1979 | United Kingdom . | |

*Primary Examiner*—Carl D. Friedman

*Attorney, Agent, or Firm*—Baldwin, Egan, Hudak & Fetzer

[57] ABSTRACT

A knock-down merchandise display unit adapted for use as an end cap device for an elongated merchandise display structure, and comprising a plurality of generally vertically spaced trays having pockets formed therein for receiving and displaying merchandise, with the trays being vertically spaced with respect to one another by separate spacer members supporting the trays in spaced relation. The spacer members provide for either lateral offsetting the trays with respect to one another so that the trays are disposed in a generally terraced arrangement, or for generally aligning the trays vertically with respect to one another, to thus obtain a plurality of possible orientational and visual effects for the display unit.

15 Claims, 7 Drawing Sheets

KNOCK-DOWN END CAP MERCHANDISE DISPLAY UNIT COMPRISING VERTICALLY SPACED MERCHANDISE RECEIVING TRAYS PROVIDED WITH FORWARD AND REARWARD ADJUSTMENT THEREOF

This invention relates in general to improvements in merchandise display racks of the type formed of a plurality of vertically spaced trays having pockets therein for receiving and displaying merchandise, such as for instance greeting cards, and more particularly relates to a knock-down type merchandise display rack of the latter described type wherein the trays can be either positioned so as to be in generally vertically aligned relationship with respect to one another, or positioned so as to be staggered so as to form a terraced relationship to one another in a vertical direction, to thus provide for a plurality of possible orientational and visual effects for the display rack.

BACKGROUND OF THE INVENTION

There are many types of merchandise display racks of the knock-down variety known in the prior art. Many of these merchandise display racks are adapted to display greeting cards and/or other material or products, generally of the paper based type.

It is also known in the prior art to provide a merchandise display rack or unit wherein sections thereof are relatively adjustable forwardly and rearwardly with respect to one another, for obtaining a particular effect and advantage for displaying merchandise. U.S. Pat. No. 2,283,301 dated May 19, 1942 to D. T. Daddell and entitled Merchandise Display Cabinet, discloses one type of merchandise display rack of the latter described type.

It is also known in the prior art to produce merchandise display units formed of plastic and having pockets therein, for receiving merchandise for display. U.S. Pat. No. 3,191,776 dated June 29, 1965 to S. G. Tokash and entitled Adjustable and Expandable Display Rack Riser, discloses one such arrangement.

SUMMARY OF THE INVENTION

The present invention provides a novel knock-down, lightweight merchandise display rack formed of a plurality of generally vertically spaced trays having pockets therein for receiving and displaying merchandise, and with a plurality of separate spacer members coacting between adjacent trays and supporting the latter intermediately thereof in said spaced relation, so that the entire display rack can be relatively rapidly set up or knocked down for ease in assembling and/or taking down and moving the latter, and wherein the tray members are able to be generally aligned with one another in a vertical direction, or to be staggered with respect to one another in a vertical direction, so as to provide various possible orientational and visual effects to the display rack, depending upon what is desired. The display rack is particularly adapted for use as an end cap device for an associated elongated merchandise display structure.

Accordingly, an object of the invention is to provide a novel knock-down merchandise display rack comprised of a plurality of vertically spaced trays having pockets therein for receiving and displaying merchandise.

Another object of the invention is to provide a knock-down display rack of the aforementioned type wherein the spaced trays can be adjusted forwardly or rearwardly relative to one another, so as to effect a vertically aligned condition of the trays with respect to one another, or an offset condition of the trays with respect to one another in a vertical direction, to provide for selective varying of the tray orientation and visual effect thereof provided by the display rack, and to obtain the maximum advantage for displaying merchandise under various conditions.

A still further object of the invention is to provide a display rack of the latter described type wherein the spaced trays are supported on and maintained in spaced relationship by separate spacer members which are received within recess portions of the trays and intermediate the latter for supporting the merchandise display trays in their vertically spaced relationship.

A still further object of the invention is to provide a display rack of the aforedescribed type in which the trays and the spacer members are formed of plastic, thereby providing a relatively lightweight, knock-down merchandise display rack.

A still further object of the invention is to provide a display rack of the aforementioned type wherein the trays are vacuum molded of plastic, and wherein each of the trays includes a recessed portion in the upper side thereof adapted to receive and position the lower end of an associated spacer member, with such recess portion on the underside of the respective tray defining a projection which is adapted to be received within the open upper end of the associated spacer member, for locating and positioning the tray to the next supported tray.

DESCRIPTION OF PREFERRED EMBODIMENT

Figure 4:
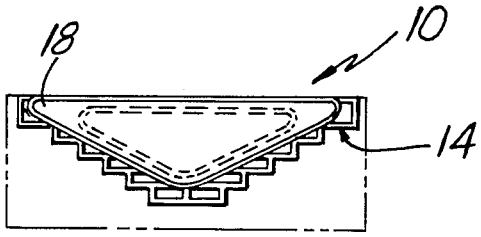
FIG. 4 is a top plan view of the FIGS. 1-3 display rack.
Figure 3:
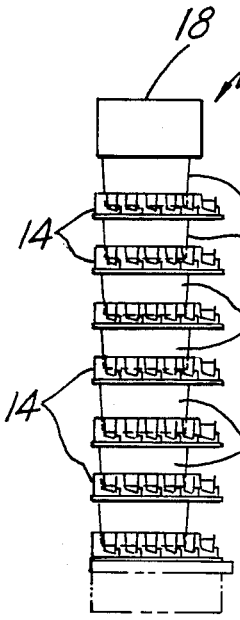
FIG. 3 is a side elevational view taken from the lefthand side of FIG. 1.
Figure 1:
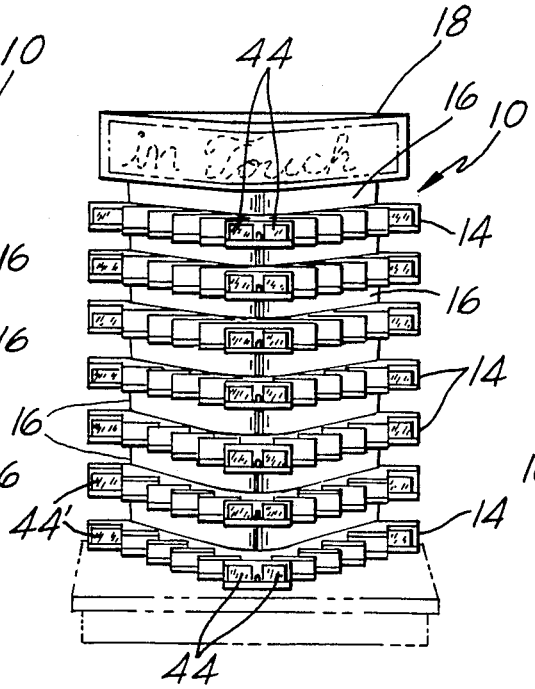
FIG. 1 is a front perspective view of a merchandise display rack embodying the invention.
Figure 2:
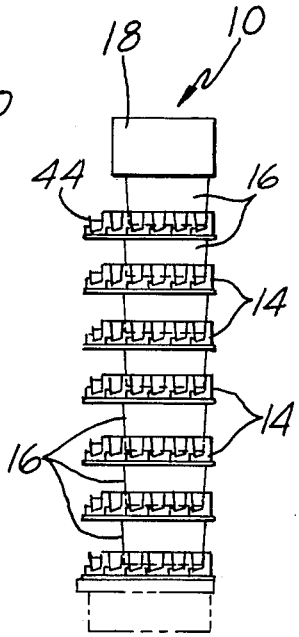
FIG. 2 is a side elevational view of the display rack of FIG. 1 taken from the righthand side of FIG. 1.
Figure 5:
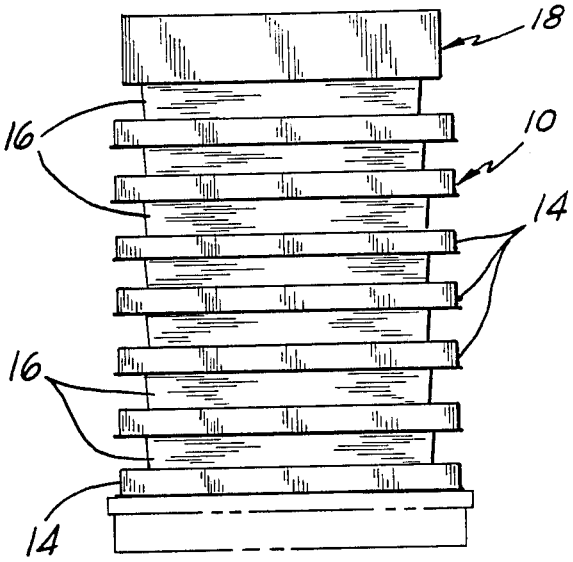
FIG. 5 is a rear elevational view of the display rack of FIGS. 1-4.
Figure 6:
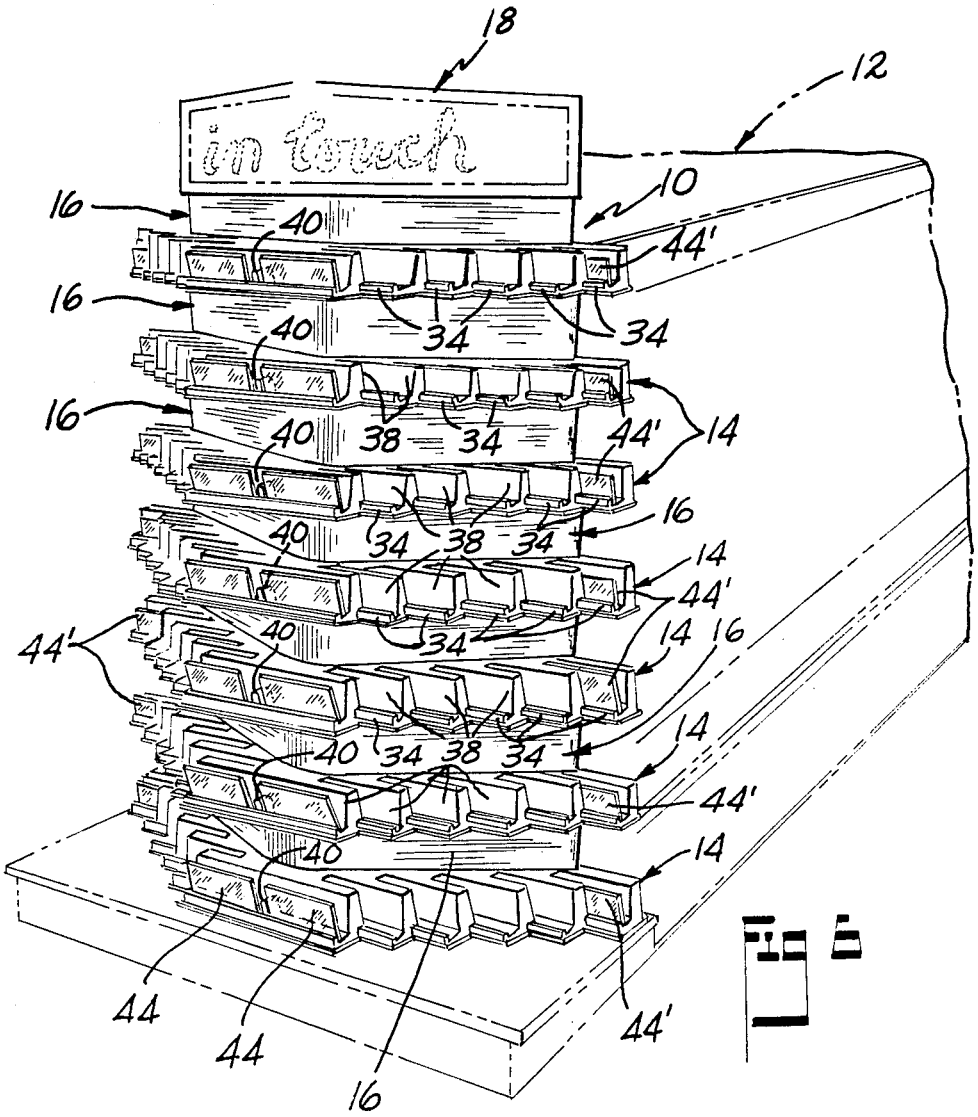
FIG. 6 is a perspective view of the display rack of FIGS. 1-5 showing its use as an end cap in conjunction with a horizontally elongated merchandise display cabinet of more or less conventional type.

Referring now again to the drawings, there is shown a display rack 10 embodying the present invention. Such display rack, in the embodiment illustrated, is especially adapted for use as an end cap member for an associated horizontally elongated merchandise display cabinet 12 (FIG. 6) so as to give a finished appearance to the overall display fixture. However, it will be understood that rack 10 may be used separately as a merchandise display unit.

End cap member 10 comprises a plurality (in the embodiment illustrated, seven) of separate tray members 14 disposed in vertically spaced relationship and being maintained in such spaced relationship by means of separate spacer members 16, with each spacer member 16 being disposed between each pair of trays, except at the top of the rack, where a sign unit 18 is supported on the uppermost spacer member 16, rather than a tray. Unit 18 may be merely set on the top of uppermost spacer member 16, or may have a recess in its underside receiving the upper end portion of the uppermost spacer so as to interlock the sign unit with the uppermost spacer, especially in a horizontal direction.

Each of the trays 14 is preferably formed of plastic, such as by vacuum molding thereof, and comprises a generally isosceles triangular shape configuration in plan (FIG. 7) with the widest portion of the triangular-like configuration being the rearward end of the tray and the narrowest portion of the triangular-like configuration being the forward end of the tray.

Each tray is provided with a plurality of pockets 20 formed therein. The pockets 20 are disposed or paired laterally of one another crosswise of the tray (FIG. 7) with each pocket of each pair being oriented generally adjacent the periphery of the respective side of the tray. Thus, the pockets form a row R (FIG. 7) of pockets adjacent each respective side periphery of the tray, and with the pockets in each row being staggered with respect to one another in the longitudinal direction of the respective tray of the display rack, and as shown.

Figures 7, 8, 9, 10, 11, 12:
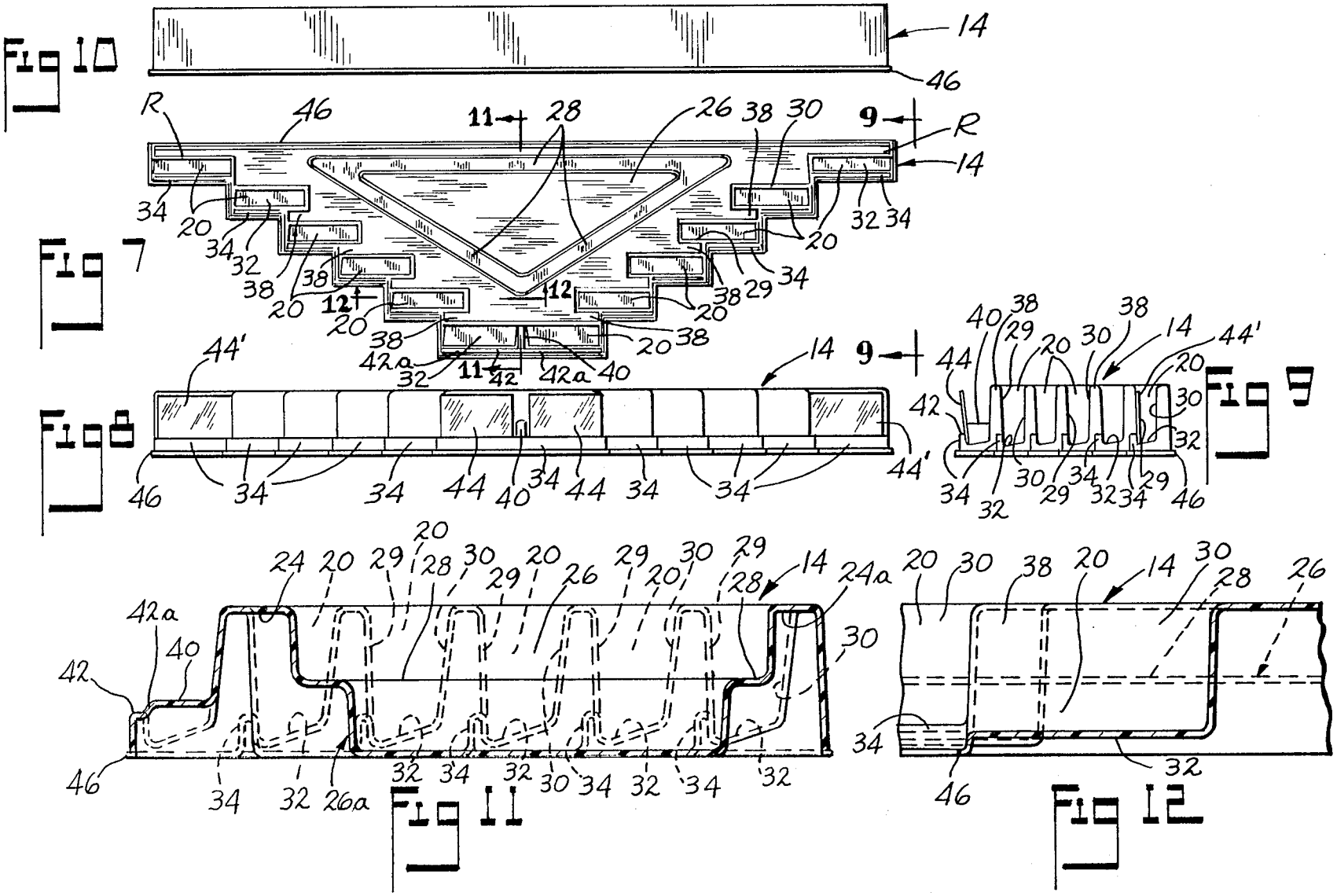
FIG. 7 is an enlarged top plan view of one of the merchandise holding trays of the display rack of FIGS. 1-6.
FIG. 8 is a front elevational view of the FIG. 7 tray.
FIG. 9 is a side elevational view of the tray of FIG. 7, taken generally along the plane of line 9—9 of FIG. 7, looking in the direction of the arrows.
FIG. 10 is a rear end elevational view of the tray of FIG. 7.
FIG. 11 is an enlarged sectional view taken generally along the plane of line 11—11 of FIG. 7, looking in the direction of the arrows.
FIG. 12 is an enlarged fragmentary sectional view taken generally along the plane of line 12—12 of FIG. 7, looking in the direction of the arrows.
Figure 16:
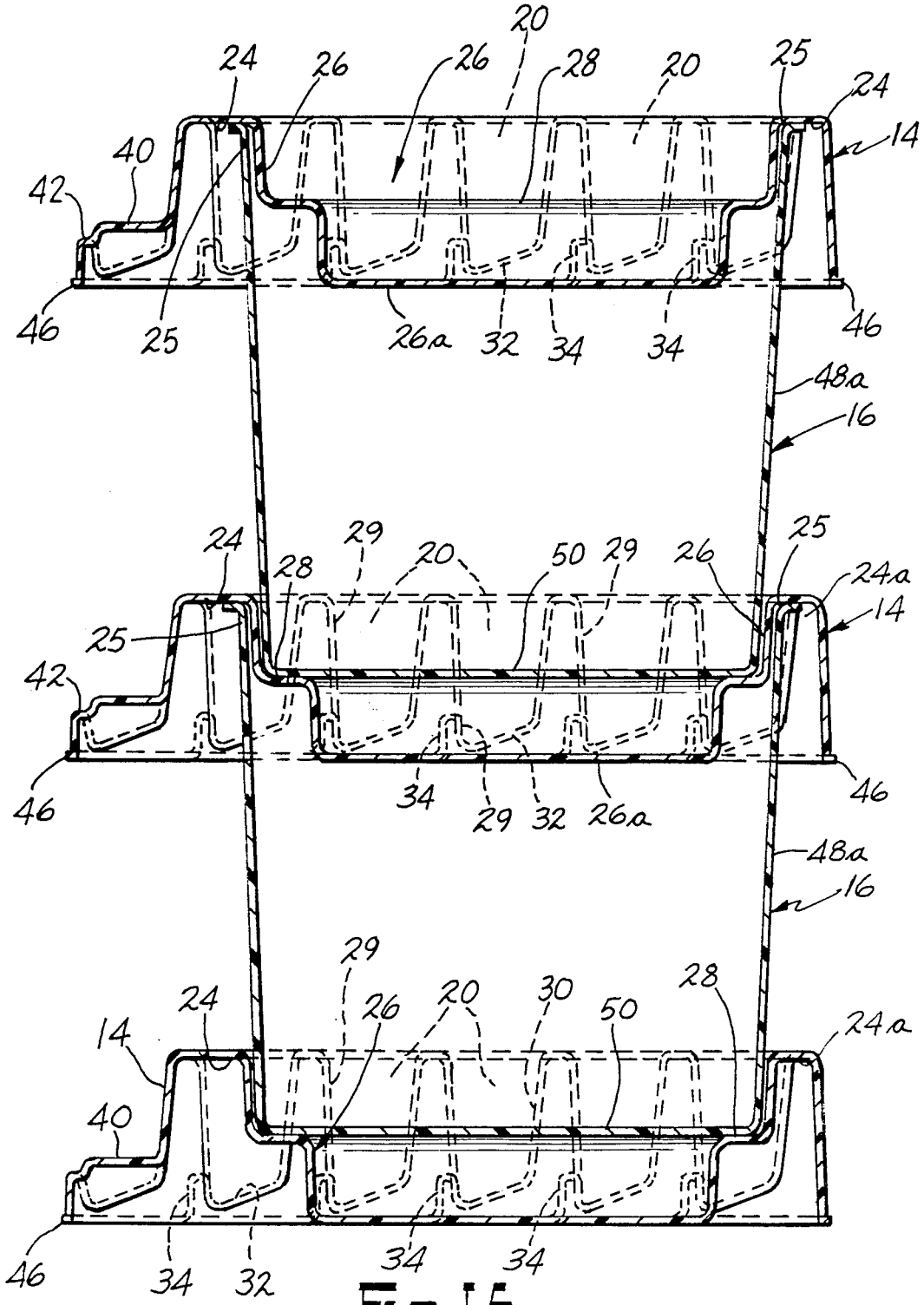
FIG. 16 is an enlarged, fragmentary vertical sectional view of the tray members and the coacting spacer members of the display rack, utilizing the spacer member of FIGS. 13–15.
Figure 20:
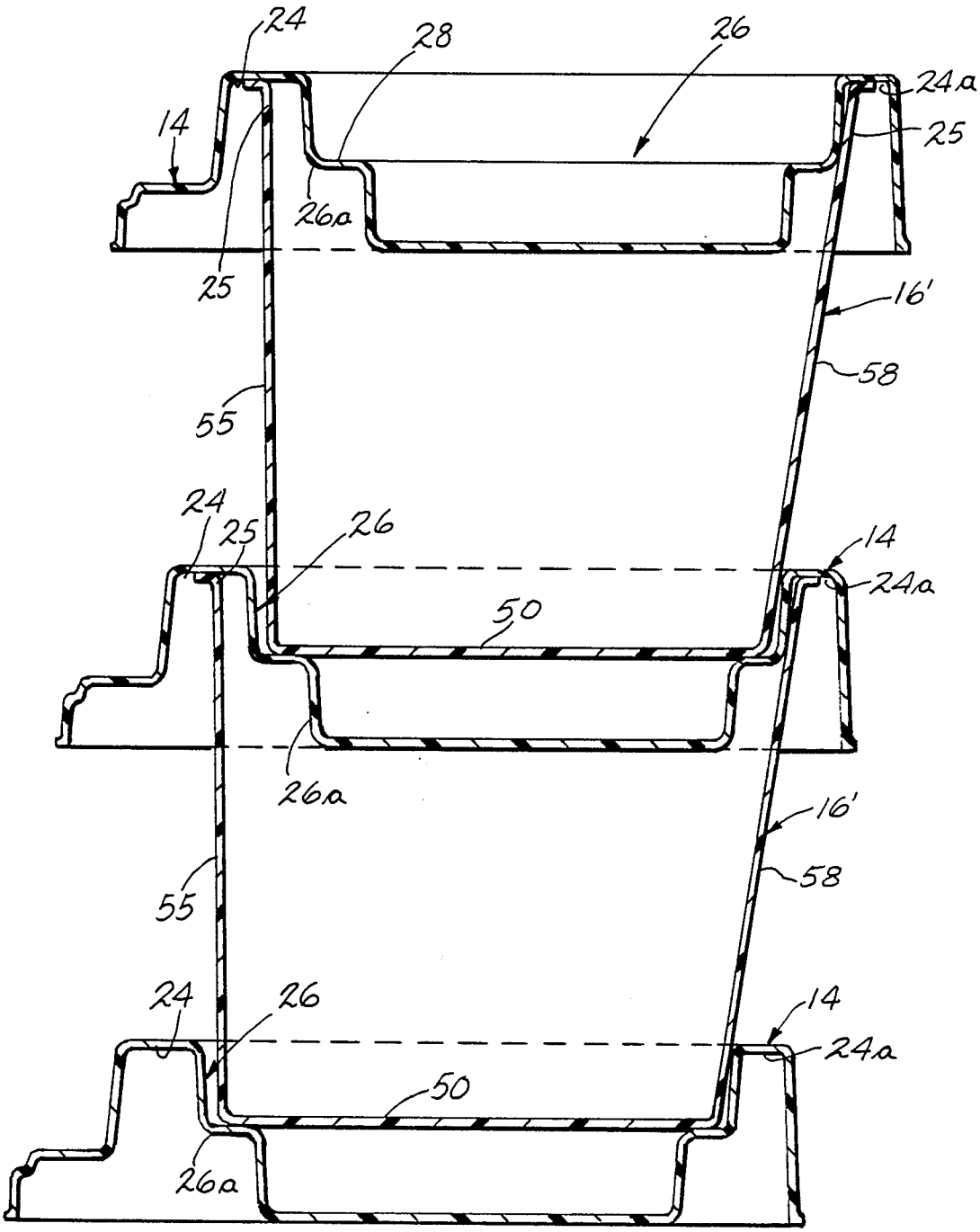
FIG. 20 is an enlarged fragmentary, vertical sectional view of the tray members and coacting spacer members of the FIGS. 17–19 embodiment thereof, to provide for the terraced or offset orientation of the merchandise holding trays of the display rack.

As can be best seen in FIGS. 11, 16 and 20, each tray 14 in its structural formation is provided with recessed areas 24, **24*a* in its underside which are adapted to receive therein portions 25 of the associated supporting spacer member (e.g. 16**) thus supporting a respective tray with respect to the next underlying tray.

Each tray has a generally central recess 26 (when viewed in top plan) formed therein, with such central recess being stepped in a vertical direction about its periphery (FIG. 11) to provide a support shelf surface 28 extending, in the embodiment illustrated, completely about the interior of the associated recess 26. Support shelf surface 28 is adapted for receiving the bottom portion of a respective spacer member thereon in supported relationship, thus supporting and locating the spacer member with respect to the underlying tray for supporting of the spacer member and the next adjacent upper tray member, in said spaced relationship with respect to the underlying tray member.

The defining walls of recess 26 form a projection **26*a* extending from the underside of the respective tray and which is received within the open top of the underlying supporting spacer member 16, as will be hereinafter described in greater detail. Projection 26*a* is spaced from the interior surfaces of the defining exterior walls of the respective tray to provide the aforementioned recessed areas 24, 24*a*** of the tray.

Referring now in particular to FIGS. 7, 9, 11 and 12, it will be seen that the merchandise receiving pockets 20 in each tray are defined by generally inwardly sloping (in a downward direction) front and rear surfaces 29, 30 and a downwardly and forwardly sloping bottom surface 32. This downwardly and forwardly sloping bottom surface 32 of each pocket urges the merchandise, such as for instance, greeting cards, stacked in the respective pocket, forwardly toward the frontal surface 29. Pockets 20 are closed on their inner lateral ends and open on the outer lateral ends thereof as best seen in FIG. 9, for ease in inserting merchandise into and removing merchandise from the pockets of the respective tray.

Each pocket 20 except for the two forwardmost pockets and two rearwardmost pockets, is defined in part by frontal shoulder portion 34 of relatively small height as can be best seen in FIGS. 9 and 11, and a higher body section 38 of the formed tray 16. Frontal surface 29 traverses both shoulder portion 34 and body section 38. Thus the higher body sections 38 each provides a forward, substantial height abutment for the greeting cards, while the lower lateral shoulder portions 34 while forming a forward abutment for the lower portions of the merchandise or greeting cards, expose the greeting cards to view from the front of the display rack, and yet aid in retaining the cards or other merchandise within the respective pocket. As can be best seen in FIG. 11, the bottom walls of the pockets 20 embodying aforementioned surfaces 32, are disposed below the shoulder or step portion surface 28 of the central recess in the respective tray mounting the associated spacer member thereon.

A divider wall section 40 extending longitudinally of the respective tray, separates the forwardmost pockets 20 at the front end of the respective tray. The top surface of the wall section 40 may be rounded (FIG. 6) which facilitates its molding during vacuum formation of the tray. Divider wall 40 terminates adjacent the frontal shoulder surface 42 on the tray. A transparent retainer panel 44 is preferably provided for each front pocket, for a greater height abutment for the merchandise. Panel 44 may be secured in the respective pocket as by gluing.

A lip 46 may be provided extending completely about the lower end of the tray, with the lip following the step-like orientation (in plan) of the spaced pockets. Lip 46 extends across the front of the tray at the lower end of the frontal wall 34, and also along the sides and the rear of the respective tray, in the embodiment illustrated.

Figure 15:
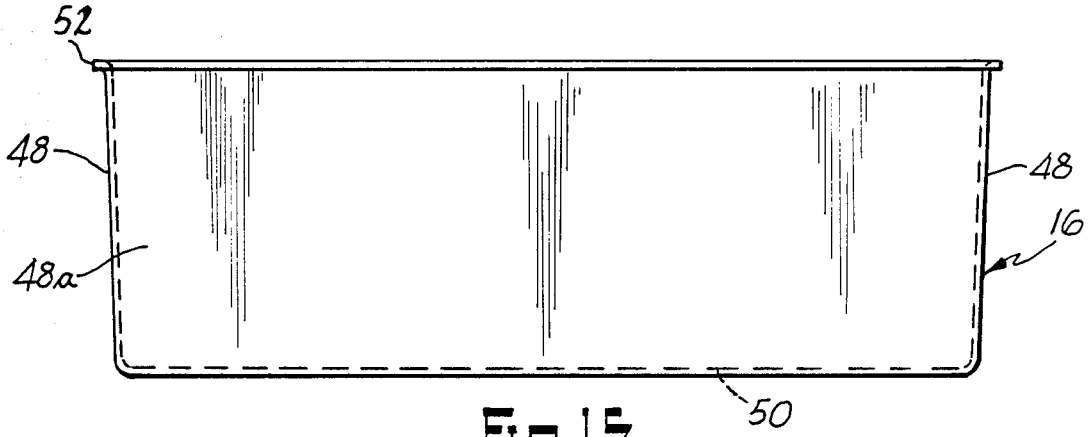
FIG. 15 is a rear elevational view of the spacer member of FIGS. 13 and 14 taken generally along the plane of line 15—15 of FIG. 14, looking in the direction of the arrows.
Figure 14:
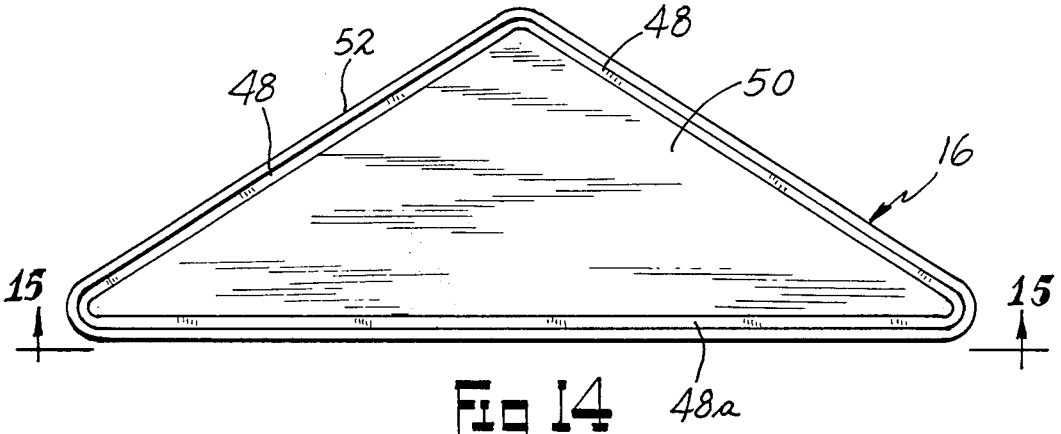
FIG. 14 is a top plan view of the spacer member of FIG. 13.
Figure 13:
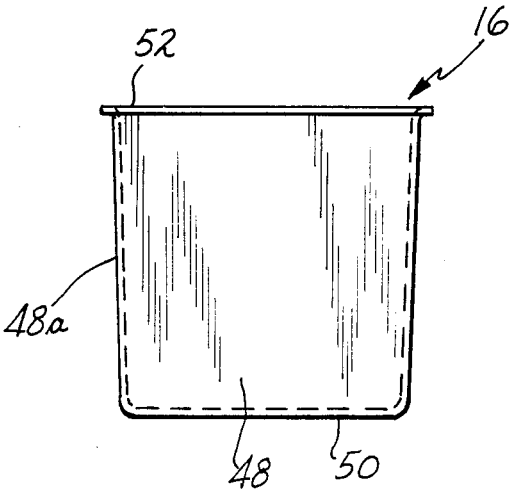
FIG. 13 is a side elevational view of one of the spacer members of the display rack.

Referring now to FIGS. 13 to 15, each of the aforementioned spacer member 16 includes side walls 48, a back wall 48*a*, and a connecting bottom wall 50, with the side and back walls preferably having a lip 52 adjacent their upper ends, extending around the triangular shaped (in plan) spacer member. The side walls 48 and back wall 48*a* are disposed uniformly obliquely with respect to the vertical so that they diverge somewhat outwardly in an upward direction, and as best shown in FIGS. 13 and 15. In the embodiment illustrated, such divergence is between 2 to 3 degrees from the vertical, and which is preferred. Such sloping side and back walls are adapted to be disposed in relatively close fitting relationship to the generally complementary sloped defining vertical walls of the central recess 26 in the underlying tray member, when the spacers 16 and trays 14 are assembled in their stacked relation as illustrated for instance in FIGS. 1 through 4. Spacer members 16 can be readily vacuum formed of plastic, similarly to trays 14.

Referring to FIG. 16, there is shown an arrangement of the trays 14 of the invention disposed in stacked relationship and separated by spacer members 16, with the trays being generally aligned vertically with respect to one another. The type of spacer used with this type of arrangement is that shown in FIGS. 13 to 15. The lipped upper ends 25 of the spacer members 16 are received within the provided space 24, 24*a* of the supported tray, with the bottom wall and the lower portions of the side and back walls 48, 48*a* of the spacer member being received within the central recess 26 of the underlying tray. As may be best seen in FIG. 16, recessed areas 24, 24*a* and particularly area 24, are of greater longitudinal dimension as compared to lipped portions 25 of the supporting spacer 16, so that in the vertical aligned condition of the trays, the spacer portions 25 are disposed generally inwardly (or rearwardly) in tray areas 24, 24*a*. By such positioning, the trays 14 are generally aligned with the underlying and overlying trays, and thus provide an expeditious arrangement for supporting the trays in vertically aligned and supported condition.

Figures 17, 18, 19:
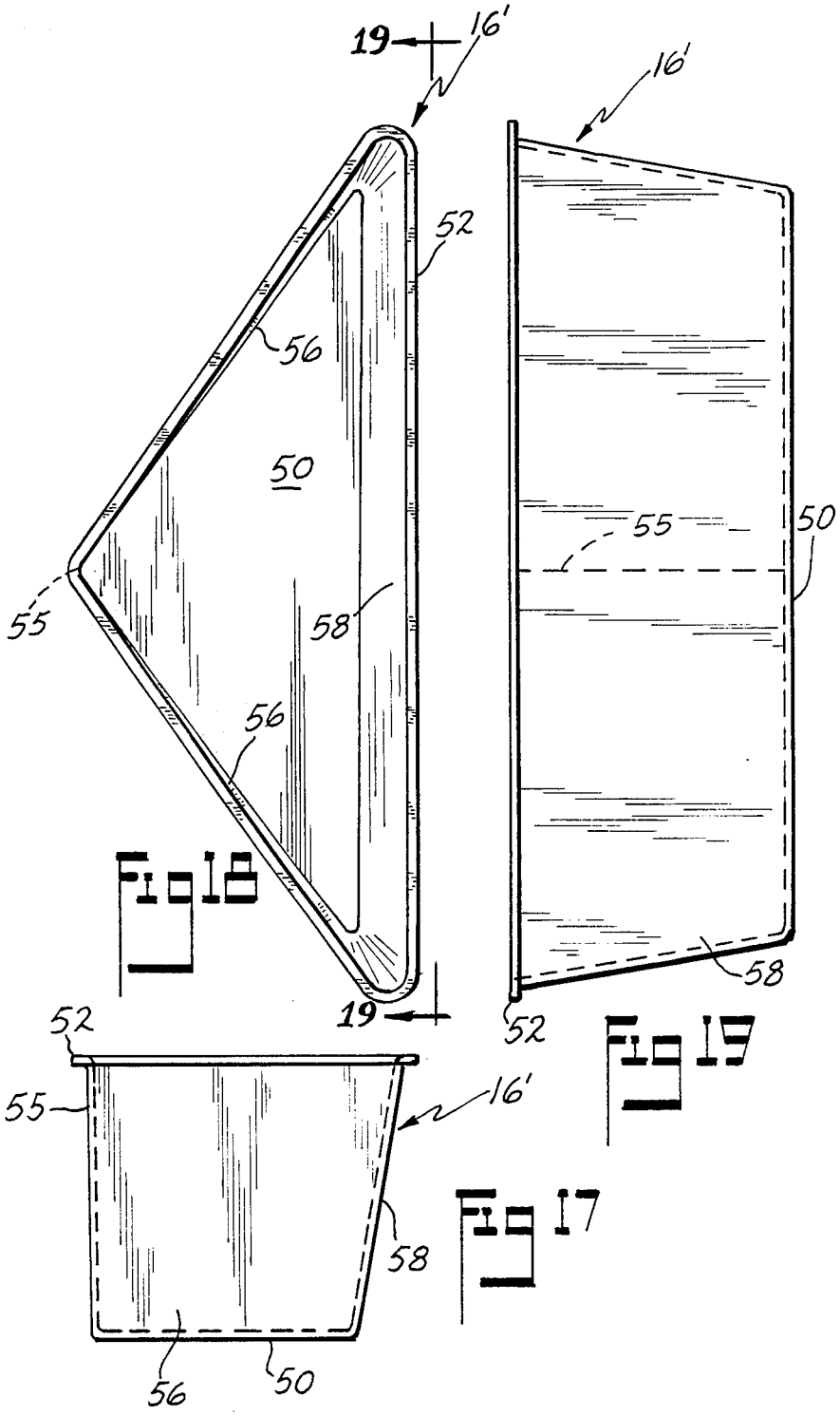
FIGS. 17, 18 and 19 are respectively side, top and rear elevational views of a modified spacer member useable with the tray member of FIGS. 7–12, to provide the provision of a terraced or offset orientation of the trays, when assembled into a display rack.

Referring now to FIGS. 17, 18 and 19, there is shown a form of spacer member 16' which is utilized in the assembly of the trays and spacer members to produce an offset or staggered and terraced relationship of the trays 14 with respect to one another in a vertical direction, and as shown in FIG. 20. Each such spacer member has a rear wall 58 which is obliquely disposed with respect to the vertical and slopes outwardly in an upward direction, and with the nose 55 of the spacer member being substantially vertically oriented, so that the side walls 56 immediately at the nose are substantially vertical and then commence to slope or diverge outwardly in an upward direction, as they extend back toward the rear wall 58 of the spacer member, to a juncture therewith. In other respects, spacer member 16' may be generally similar to spacer members 16. Rear wall 58 is preferably oriented at approximately 10 degrees with respect to the vertical.

Referring now to FIG. 20, there is shown a vertically sectioned illustration of a plurality of the trays 14 assembled with space members 16', with the trays 14 being thus oriented in offset or staggered relation with respect to one another in a vertical direction, to give a terraced appearance to the display rack. It will be seen that the projection 26*a* on the underside of each tray defining space areas 24, 24*a* enables the receipt therein of the upper flanged side and rear walls of the respective spacer member 16' and enables the vertically spaced trays to be oriented in staggered relation with respect to one another to provide the terraced orientation of the display rack, and with the bottom wall 50 of each spacer member 16' supported on the step surface portion 28 of the underlying tray. Since the nose 55 of the spacer 16' is substantially vertical and the rear wall is oblique, it will be seen that the underlying tray is forwardly disposed with respect to the supported overlying tray, thus providing a staggered or terraced orientation to the trays. In such position, the upper spacer portion 25 especially in tray area 24, is disposed generally outwardly (or forwardly) in such tray area, and as compared to the position occupied by spacer portion 25 in the first described FIG. 16 embodiment, and with the rear wall 58 of spacer 16' generally engaging confronting tray projection 26*a*, as shown in FIG. 20. Accordingly, the trays can be arranged in desired relationship, either vertically aligned as shown in FIG. 16, or staggered in a vertical direction, as shown in FIG. 20, to provide the desired orientation and aesthetic appearance to the merchandise rack.

In the embodiment illustrated, the rearward-most pocket in each row R of pockets in each tray, is defined more or less solely by the associated reduced height shoulder portion 34 (FIG. 7). Therefore, a plastic retainer panel 44' of preferably clear plastic or the like, is preferably provided for providing a front greater height abutment for the merchandise disposed in such rearwardmost pockets. Panel 44' may be glued in the respective rear pocket. In the other pockets in each row other than the front pockets, the body sections 38 defining a portion of the front boundary of the respective pocket, provide a sufficient greater height frontal abutment for the merchandise disposed in such pocket.

From the foregoing description and accompanying drawings it will be seen that the invention provides a novel merchandise display rack adapted for use as an end cap member for a horizontally elongated display cabinet although it can be used by itself, and comprising a plurality of vertically spaced trays having pockets for receiving and displaying merchandise, such as for instance greeting cards or the like, and with there being separate spacer members coacting with adjacent trays intermediate the latter, and supporting the trays in the enumerated spaced relationship, with the display rack being able to be readily knocked down and set up elsewhere. The trays are provided with space areas in the underside thereof which are adapted to receive therein portions of the associated spacer members for the display rack assembly, for supporting the trays on the spacer members and maintaining them in the vertically spaced relationship. Such space area means on the trays in combination with the selected spacer members, provide for effecting an offset relation of the trays with respect to one another in a vertical direction or for effecting an aligned relation of the trays with respect to one another in a vertical direction depending upon the spacer utilized, with such offset and aligned relationships providing for selectively varying the visual and orientational effects provided by the display rack.

The terms and expressions used have been used as terms of description, and not of limitation, and there is no intention in the use of such terms and expressions of excluding any equivalents of any of the features shown or described, or portions thereof, and it is recognized that various modifications are possible within the scope of the invention claimed.

I claim:

1. A knock-down merchandise display rack comprising a plurality of generally vertically spaced substantially identical trays having upwardly opening pockets therein readily accessible from exteriorly of the respective tray for receiving and displaying merchandise, such as for instance greeting cards, and separate individual spacer members coacting with adjacent trays intermediate the latter and supporting the latter in said spaced relation, said spacer memebers each having means thereon coacting with means on said trays for providing for effecting a laterally offset or terraced relation of said trays with respect to one another in a vertical direction or for effecting an aligned relation of said trays with respect to one another in a vertical direction, said offset and said aligned relationships providing for selectively varying the orientational and visual effect provided by said display rack, each said tray including a top surface having therein a generally centralized recess receiving therein an associated one of said spacer members in supported relation for spacing adjacent trays vertically with respect to one another, said pockets in each tray being disposed laterally of the associated spacer member, each said spacer member being open on its upper end, said recess being defined in a vertical direction by step portions so as to provide a generally horizontal support shelf therein and receiving the respective of said spacer members in supported relation on said support shelf, said recess and support shelf defining a projection portion on the underside of the respective tray received in said open upper end of the coating underlying spacer member.

2. A display rack in accordance with claim 1 wherein each of said trays is formed of molded plastic and wherein said means on said trays includes a recessed area in the underside of each of said trays adapted to receive in supported relationship the upper portion of a respective underlying spacer member, said upper portion comprising said spacer member means, said recessed area being of a greater dimension longitudinally as compared to the corresponding longitudinal dimension of said coacting means on the respective spacer member, so that in said vertical aligned relation of said trays, said coacting means of said spacer member in the respective recessed area of the overlying said tray is disposed generally rearwardly therein and in said lateral offset relation of said trays, said coacting portion of said respective spacer member is disposed generally forwardly in said respective recessed area.

3. A display rack in accordance with claim 2 wherein each said spacer member comprises a hollow polygonal shaped member in plan, including side walls, said side walls being received within said recessed area of the respective overlying one of said trays and supporting the respective tray in spaced relationship to the underlying tray with said projection portion received in said open upper end of the respective underlying spacer member, the lower end portions of said side walls of each of said spacer members being received in said recess of the adjacent underlying tray and being supported on said support shelf therein, thus spacing adjacent of said trays in said vertically spaced relation with respect to one another.

4. A display rack in accordance with claim 3 wherein each said spacer member includes a bottom wall connecting the side walls with laterally extending flanges projecting generally horizontally outwardly from the upper ends of said side walls to define said open upper end for each said spacer member, said flanged side walls being received in said recessed area of the overlying tray while the lower ends of said side walls and said bottom wall are received in said recess of said underlying tray, said recess being of generally complementary polygonal shape in plan to said polygonal shape in plan of the respective spacer member.

5. A display rack in accordance with claim 1 including an outwardly projecting generally horizontal lip on the lowermost edge of each respective tray.

6. A display rack in accordance with claim 1 wherein said projection portion on the underside of each respective tray is spaced from the defining exterior sides of the respective tray, each said spacer member being generally triangular shaped in plan and shaped complementary to said central recess in the underlying tray.

7. A display rack in accordance with claim 6 wherein each of said spacer members comprises side walls and a diagonally oriented rear wall coacting to form a hollow generally triangular shaped, in plan, spacer member open on the upper end thereof.

8. A display rack in accordance with claim 6 wherein each of said spacer members comprises side walls and a rear wall which slope upwardly and outwardly generally uniformly relative to one another to define a hollow triangular shaped, in plan, spacer member open at the upper end thereof.

9. A display rack in accordance with claim 6 wherein said central recess is of generally isosceles triangular shaped configuration, in plan, and said shelf running continuously about the interior periphery of said central recess and receiving thereon a respective one of said spacer members in supported relation, the vertical portions of the defining walls of said central recess being generally obliquely disposed with respect to the vertical.

10. A knock-down merchandise display rack comprising a plurality of generally vertically spaced substantially identical trays having upwardly opening pockets therein for receiving and displaying merchandise, such as for instance greeting cards, and separate individual spacer members coacting with adjacent trays intermediate the latter and supporting the latter in said spaced relation, said spacer members each having means thereon coacting with means on said trays for providing for effecting a laterally offset or terraced relation of said trays with respect to one another in a vertical direction or for effecting an aligned relation of said trays with respect to one another in a vertical direction, said offset and said aligned relationships providing for selectively varying the orientational and visual effect provided by said display rack, and wherein each of said trays in top plan is of generally isosceles triangular shape configuration, with the widest portion of said triangular configuration being the rearward end of said tray, and the narrowest portion of said triangular configuration being the forward end of said tray, said pockets in said tray being disposed in pairs and being oriented generally adjacent the periphery of the respective side of said tray, and being spaced laterally with respect to one another, to form a row of said pockets adjacent each side periphery of said tray, said pockets in each said row being staggered with respect to one another in a direction longitudinally of each said tray to provide a step-like configuration in plan to said side peripheries of said tray, said tray having a top side central recess therein spaced laterally from said pockets, with said central recess being defined by stepped portions in a vertical direction, so as to provide a generally horizontal support shelf therein adapted for receiving a respective of said spacer members in supported relationship on said support shelf, the defining walls of said central recess being sloped inwardly in a downward direction and the side walls of said spacer member being sloped generally complementarily and receiving said spacer member in said central recess of said respective tray, in relatively closely spaced relation to said defining walls of said central recess, said pockets being open on the outer lateral sides thereof, for convenient insertion of and removal of merchandise from said pockets.

11. A knock-down merchandise display rack comprising a plurality of generally vertically spaced substantially identical trays having upwardly opening pockets therein for receiving and displaying merchandise, such as for instance greeting cards, and separate individual spacer members coacting with adjacent trays intermediate the latter and supporting the latter in said spaced relation, said spacer members each having means thereon coacting with means on said trays for providing for effecting a laterally offset or terraced relation of said trays with respect to one another in a vertical direction or for effecting an aligned relation of said trays with respect to one another in a vertical direction, said offset and said aligned relationships providing for selectively varying the orientational and visual effect provided by said display rack, and wherein each of said trays in top plan is of generally isosceles triangular shaped configuration with the widest portion of said triangular configuration being the rearward end of said tray and the narrowest portion of said triangular configuration being the forward end of said tray, said pockets in said tray being disposed in pairs and being spaced laterally of one another to form a row of pockets adjacent each respective side periphery of said tray, said pockets in each said row being staggered with respect to one another in a direction longitudinally of said tray to provide a step-like configuration in plan to said side peripheries of said tray, said tray having a top surface with a central recess therein including a support portion extending about the interior periphery of said recess to provide an upwardly facing support shelf receiving a respective of said spacer members in supported relation thereon, said recess and support shelf defining a projection portion on the underside of said tray received in an opening in the upper end of the coacting underlying spacer member.

12. A display rack in accordance with claim 11 including a laterally extending generally horizontal lip projecting outwardly from the exterior of the tray adjacent the bottom extremity thereof and extending completely about said tray.

13. A display rack in accordance with claim 11 wherein each pocket is defined in part by generally downwardly and inwardly sloping front and rear surfaces and a downwardly and forwardly sloping bottom surface, said downwardly and forwardly sloping bottom surface of each pocket being adapted to urge merchandise, such as for instance, greeting cards stacked in a respective pocket, in a direction forwardly toward said front surface of the respective pocket, at least certain of said pockets each being closed at its lateral inner end, and open on its lateral outer end for ease in inserting merchandise into and removing merchandise from the respective pocket, each said certain pockets except for the two rearwardmost pockets of said tray being defined in part by a frontal shoulder portion of relatively small height and providing a portion of said front surface and a higher laterally disposed body section of the formed tray and providing the remaining portion of said front surface, said higher body section and associated portion of said front surface providing a forward substantial height abutment for merchandise in the respective pocket, such as greeting cards, while said lower lateral shoulder portion forms a forward abutment for the lower portion of the merchandise in the respective pocket, but exposes the merchandise to view from the front of the display rack, the forwardmost pair of pockets of said tray being separated by a longitudinal divider wall.

14. A display rack in accordance with claim 13 wherein each of said forwardmost pockets includes a transparent retainer panel projecting upwardly therefrom adjacent the front surface thereof and adapted to retain the merchandise in the respective forwardmost pocket.

15. A knock-down merchandise display rack comprising a plurality of generally vertically spaced substantially identical trays having upwardly opening pockets therein readily accessible from exteriorly of the respective tray for receiving and displaying merchandise, such as for instance greeting cards, and separate individual spacer members coacting with adjacent trays intermediate the latter and supporting the latter in said spaced relation, said spacer members each having means thereon coacting with means on said trays for providing for effecting a laterally offset or terraced relation of said trays with respect to one another in a vertical direction, or for effecting an aligned relation of said trays with respect to one another in a vertical direction, said offset and said aligned relationships providing for selectively varying the orientational and visual effect provided by said display rack, each said tray having a top surface with a generally centralized recess therein including a step portion extending about the interior periphery of said recess to provide an upwardly facing support shelf receiving a respective one of said spacer members in supported relation thereon, said recess and support shelf defining a projection portion on the underside of each said tray, and received in an opening in the upper end of the coacting underlying spacer member, said pockets in each said tray being disposed laterally of said centralized recess therein, each said spacer member being polygonal shape in plan and said recess in each said tray being of generally complementary polygonal shape in plan to said polygonal shape in plan of the respective spacer member.

* * * * *